United States Patent [19]

Boynton

[11] Patent Number: 4,545,703

[45] Date of Patent: Oct. 8, 1985

[54] CONCRETE FACED BIN WALL

[75] Inventor: Jerald H. Boynton, Franklin, Ohio

[73] Assignee: Armco Inc., Middletown, Ohio

[21] Appl. No.: 465,170

[22] Filed: Feb. 9, 1983

[51] Int. Cl.[4] ..... E02D 17/00; E02D 29/02

[52] U.S. Cl. ..... 405/273; 405/286

[58] Field of Search ..... 405/262, 272–275, 405/284–287, 279

[56] References Cited

U.S. PATENT DOCUMENTS

| | | | |
|---|---|---|---|
| 1,213,437 | 1/1917 | Upson | 405/275 |
| 1,366,029 | 1/1921 | Seaman | 405/275 |
| 1,428,595 | 9/1922 | Kircher | 405/273 |
| 1,843,041 | 1/1932 | Nagle . | |
| 1,871,439 | 8/1932 | Alexander | 405/273 |
| 1,871,488 | 8/1932 | Alexander | 405/273 |
| 1,907,053 | 5/1933 | Flath | 405/273 |
| 1,909,539 | 5/1933 | Huntoon | 405/273 |
| 2,462,775 | 2/1949 | Pontiere | 405/286 |
| 2,880,588 | 4/1959 | Moore | 61/39 |
| 3,613,382 | 10/1971 | Dickinson | 405/285 |
| 3,614,870 | 10/1971 | Boynton | 61/47 |
| 3,631,682 | 1/1972 | Hilfiker | 405/273 |
| 3,686,873 | 8/1972 | Vidal | 61/39 |
| 3,922,864 | 12/1975 | Hilfiker | 405/262 |
| 4,068,482 | 1/1978 | Hilfiker | 405/272 |
| 4,116,010 | 9/1978 | Vidal | 405/286 X |
| 4,154,554 | 5/1979 | Hilfiker | 405/273 |
| 4,220,423 | 9/1980 | Sivachenko | 405/272 X |
| 4,266,890 | 5/1981 | Hilfiker | 405/286 |
| 4,324,508 | 4/1982 | Hilfiker | 405/284 |
| 4,407,612 | 10/1983 | van Weeke | 405/285 |

FOREIGN PATENT DOCUMENTS

| | | | |
|---|---|---|---|
| 1917749 | 10/1969 | Fed. Rep. of Germany | 405/284 |

*Primary Examiner*—Cornelius J. Husar
*Assistant Examiner*—Nancy J. Stodola
*Attorney, Agent, or Firm*—Frost & Jacobs

[57] ABSTRACT

A soil tight bin-type retaining wall is formed having cementitious panels as the exposed walls including the front wall. Each end portion of the front face of each cementitious panel contacts against a flange portion of a connector positioned in the plane of the front wall to support the cementitious panel in a substantially erect position. An angle member is positioned on a web portion of a connector to retain the cementitious panel of the front wall in a substantially erect position. A plurality of stringers form the rear wall by being supported by the connectors positioned in the plane of the rear wall. A plurality of spacer members form the side walls by being supported by the web portions of a pair of connectors. In alternative embodiments, the retaining wall may be constructed so that the direction of the front or rear wall changes. Additionally, a retaining wall may be formed in which some or all of the front, rear or side walls are composed of cementitious panels. The retaining wall may also be constructed so that the flange portion of the connectors is inserted into a groove in the end portion of the cementitious panels.

21 Claims, 18 Drawing Figures

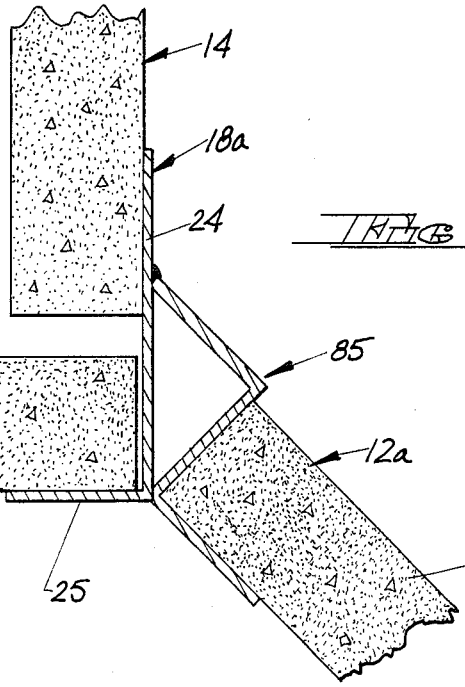
FIG 14
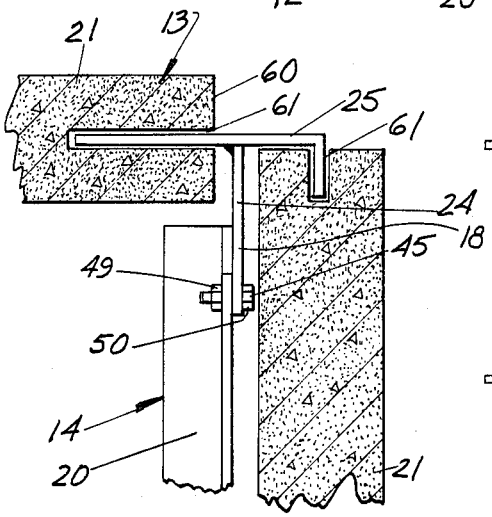
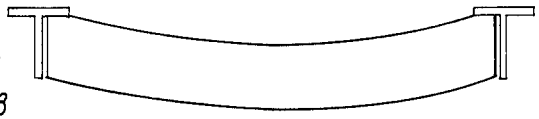
FIG 17A
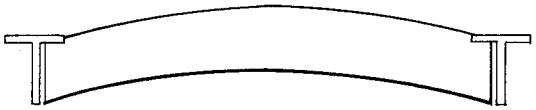
FIG 17B
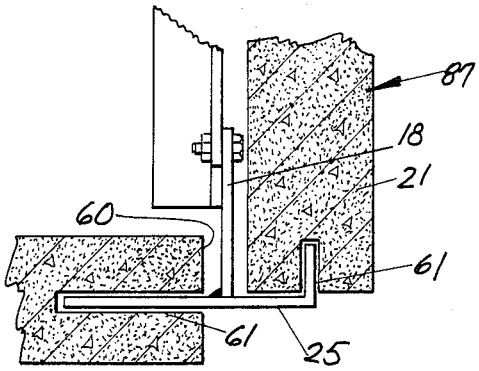
FIG 17

CONCRETE FACED BIN WALL

SUMMARY OF THE INVENTION

This invention relates to soil tight retaining walls, and, more particularly, to concrete faced bin-type retaining walls.

Bin-type retaining walls are composed of a series of adjoining bins which are backfilled with fill material, such as soil, so as to form a permanent, economical retaining wall. Current bin-type retaining walls have a wide range of commercial applications due to the relative cost efficiency, the structural strength and stability, the ease in installation, the speed in assembly, and the minimal maintenance associated with bin-type retaining walls. These structures can be assembled to meet design specifications requiring various combinations of height, length and curvature.

For architectural and aesthetic considerations, it is desirable that the front wall or the exposed wall of the retaining wall structure be composed of cementitious or concrete panels so that varying designs and patterns can be achieved. Illustrative of these designs and patterns are exposed aggregate faces, sand blasting, bush hammer, acid etching or form liners to provide an infinite number of designs. Since the front wall of the structure is often visible while the retaining wall is in place, the concrete front wall would allow the retaining wall to be used in locations and structures requiring something more architecturally and aesthetically pleasing than a mere metal wall. Additionally, due to high labor costs, a concrete front wall which can be quickly assembled into place provides an economic advantage to the user of that structure. Similarly, the other visible sides of the retaining wall, such as the ends, may also be composed of concrete panels to provide the desired aesthetic effect.

Prior art bin-type retaining walls do not provide to the industry a retaining wall structure which can be easily assembled with either a front wall, side wall or rear wall made from concrete or cementitious material. As used herein, "cementitious panels" includes panels composed of cement, concrete, cement-like material and combinations thereof. Present bin-type retaining walls, as exemplified by U.S. Pat. No. 3,617,870 issued to the inventor of the present invention, provides bin-type retaining walls wherein the front wall includes a plurality of metal stringers, each being hat-shaped in construction with outwardly extending flanges. The stringers of the front wall are lapped together and attached at the ends thereof to the vertical connectors. While this retaining wall has proven very satisfactory in a number of commercial settings, it does not fulfill the need of the industry in those situations which demand that the front wall or other exposed walls of the retaining wall be composed of cementitious panels. Hence, it would be advantageous to have a bin-type retaining wall which incorporates the numerous structural advantages of prior U.S. Pat. No. 3,617,870, but which allows the front wall and the other exposed walls to be made from concrete.

Some prior art structures provide concrete retaining walls, but they are not of the bin-type and, hence, lack the advantages associated therewith. Rather, these prior art walls include various types of concrete retaining walls in which all of the stringers and spacers are precast concrete units. Exemplary of these types of wholly cementitious retaining wall units are U.S. Pat. Nos. 4,266,890, issued to William K. Hilfiker; 3,686,873, issued to Henri C. Vidal; and U.S. Pat. No. 1,907,053, issued to Otto S. Flath.

The present invention satisfies the needs of the industry by providing a soil tight bin-type retaining wall which has many of the advantages associated with the retaining wall of U.S. Pat. No. 3,617,870, but which further allows for the easy use of a front wall or an exposed wall made of cementitious panels. The present invention furnishes a bin-type retaining wall which has both structural superiority and the desired architectural and aesthetic flexibility offered by the use of concrete front panels.

In a preferred embodiment, the present invention provides a soil tight bin-type retaining wall which comprises a plurality of pairs of T-shaped connectors, each of which has a web portion substantially normal to and positioned centrally on a flanged portion, one connector of each pair being positioned in the plane of the front wall and the other connector of each pair being positioned in the plane of the rear wall. Generally, as used hereafter, the terms "front wall" and "rear wall" can be interchanged when describing the retaining wall, with the "front wall" usually designating the wall exposed to the environment. Accordingly, the various features of the present invention which are described relative to the front wall can easily be used with the rear wall. If, for example, both the front and rear walls are exposed to the surrounding air, then it is rather arbitrary which wall is labeled "the front" and which is labeled "the rear". A plurality of stringers form the rear wall. Each of the stringers is supported by two connectors positioned in the plane of the rear wall. A plurality of spacer members form each side wall. Each spacer member is fastened to the web portion of a pair of connectors. The front wall is formed of a plurality of cementitious panels. Each end portion of the front face of each cementitious panel contacts against the flange portion of a connector positioned in the plane of the front wall to support the cementitious panel in a substantially erect position. A retaining means on the web portion of the connector retains the cementitious panel of the front wall in a substantially erect position. The retaining means may be an angle member which has a L-shaped cross section and which includes a connecting leg and a positioning leg. The bin-type retaining wall may further include a securing means on at least one bin at each end of the retaining wall for interconnecting the spacer members of the end bins to prevent the lateral displacement of the bins. The securing means may be one or more tie rods, ropes, cables or the like, which lie adjacent to the front wall. To interlock the cementitious panels of the front wall in vertical relationship to each other, one lengthwise edge of each cementitious panel may have a tongue joint which mates with a groove along a corresponding lengthwise edge of the panel positioned vertically adjacent to it.

In an alternative embodiment, the present invention provides a soil tight bin-type retaining wall which comprises a plurality of T-shaped connectors, each of which has a web portion substantially normal to and positioned centrally on a flange portion. One connector of each pair is positioned in the plane of the front wall and the other connector of each pair lies positioned in the plane of the rear wall. A plurality of stringers forms the rear wall. Each of the stringers is supported by two connectors positioned in the rear wall. A plurality of spacer members forms the side wall. Each spacer member is fastened to the web portions of a pair of connectors. A plurality of cementitious panels form the front wall with the side edge of each concrete panel having a groove corresponding in size and shape to the flange portion of the connectors. The flange portion of each connector in the plane of the front wall is inserted within the groove of horizontally adjacent cementitious panels to align the cementitious panels along the length of the front wall. The cementitious panels may further include a horizontal joint along the one lengthwise edge of each cementitious panel which mates with a groove along a corresponding lengthwise edge of the panel positioned vertically adjacent to it so as to interlock the panels together along the height of the wall. The retaining wall may further include a securing means on at least one bin at each end of the retaining wall for interconnecting the spacer members of the end bins to prevent the lateral displacement of the bins. The securing means may be one or more tie rods, ropes, cables or the like, which lie adjacent to the front wall.

In another alternative embodiment of the present invention, a direction changing means is on one or more connectors to change the direction of the wall supported by the connectors. The direction changing means for inwardly changing the wall direction includes one or more corner members having a flange portion and a web portion. The flange portion of the corner member is joined to the flange portion of a connector. The web portion of the corner member is joined to the web portion of the connector. An L-bracket is joined at each of its ends to the web portion of a connector so as to maintain the cementitious panels of the front wall in a substantially erect position at the point of the inward direction change. The direction changing means is also capable of bending the wall outwardly at the point of direction change.

In still another embodiment of the present invention, the retaining wall is constructed so as to include front, rear and side walls composed of cementitious panels. Alternatively, only some of the front, rear or side walls may be composed of cementitious panels.

DESCRIPTION OF THE DRAWINGS

FIG. 12 is a top plan view of the special corner members used in the alternative embodiment of FIG. 11.

FIG. 13 is a top plan view of a retaining wall of the present invention which the front, rear and side walls are all formed of cementitious panels.

FIG. 14 is a top plan view of a variation of FIG. 11 in which the wall's direction is outwardly changed. FIG. 15 is a top plan view of a variation of FIG. 9 in which the front, side and rear walls are composed of cementitious panels.

FIG. 16 is a top plan view of a clip-on cover for the connectors.

FIG. 17A and 17B show a top plan view of a concave and a convex faced cementitious panel, respectively.

DESCRIPTION OF THE PREFERRED EMBODIMENT

Figure 1:
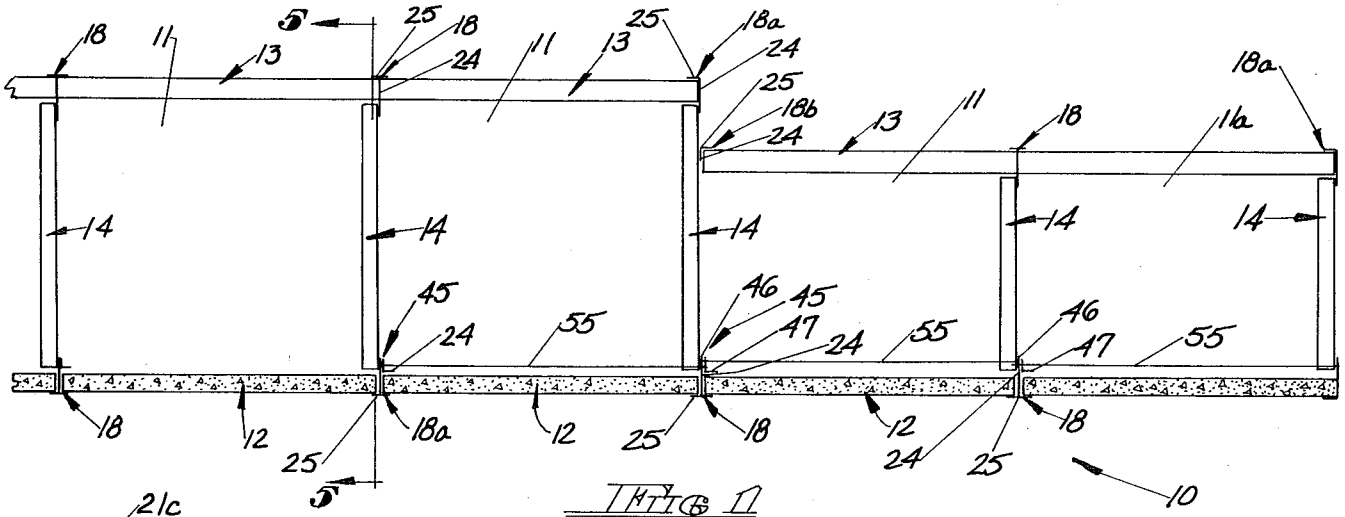
FIG. 1 is a top plan view of the soil tight bin-type retaining wall in accordance with the present invention.
Figure 5:
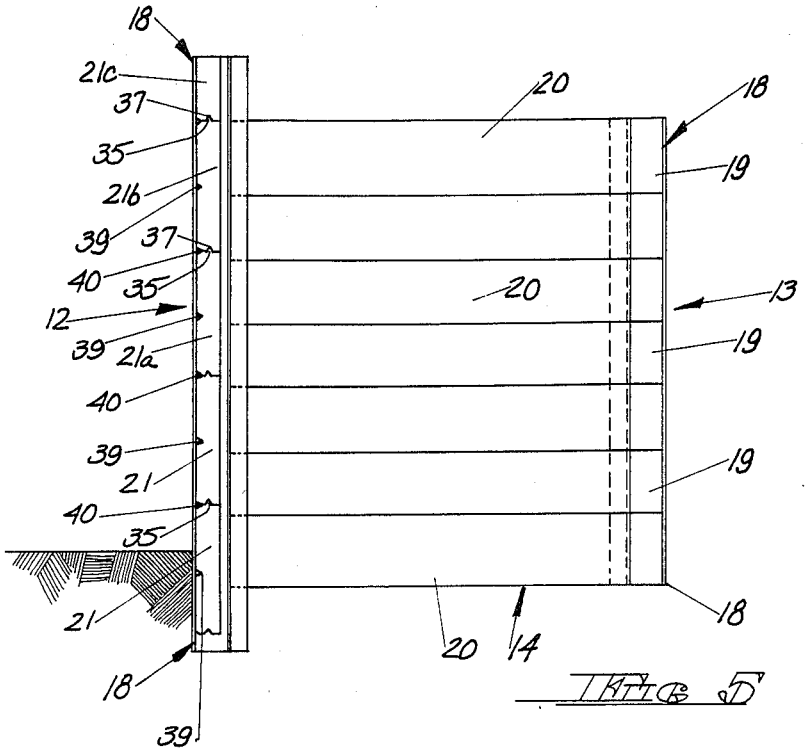
FIG. 5 is a vertical sectional view taken along the line 5—5 in FIG. 1.

Referring now to FIGS. 1 and 5, the preferred embodiment of the bin-type retaining wall of the present invention is shown. The retaining wall is composed of a series of individual closed faced bins 11. Each bin 11 has a front wall indicated generally at 12, a rear wall indicated generally at 13, and two side walls indicated generally at 14 with each of the side walls 14 being common to two bins 11. Usually, the front wall will be considered to be the wall of the bins which is exposed and visible. The bin 11 construction includes a plurality of pairs of connectors shown generally at 18, a plurality of stringers 19 forming the rear wall 13, a plurality of spacer members 20 forming the side walls 14, and a plurality of cementitious panels 21 forming the front wall 12.

Figure 8:
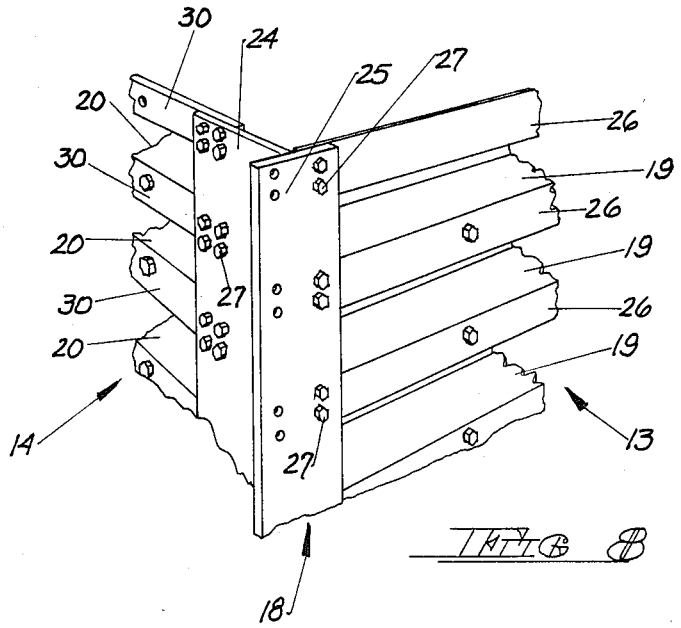
FIG. 8 is a perspective view showing one of the connectors in the plane of the rear wall, the stringers forming the rear wall and the spacing members forming the side wall.

The connectors 18, as shown in FIG. 8, are T-shaped in cross section. Each connector has a web portion 24 positioned substantially normal to and centrally on a flange portion 25. The connectors 18, as shown in FIG. 1, are positioned in pairs. One connector 18 of each pair is positioned in the plane of the front wall 12 and the other connector 18 of that pair is located in the plane of the rear wall 13. The connector 18 need not be positioned exactly perpendicular or vertical relative to the ground but rather it may be sloped or on a batter relative to the ground. In certain topographies of the retaining wall location, it may be advantageous to skew the connectors away from a perpendicular plane. At the end of the retaining wall, a corner connector 18*a*, which has only a half flange portion 25, may be used in place of the full T-shaped connector 18. When the widths of the bins vary, a corner connector 18*a* is used with a split connector 18*b*. The corner connector 18*a* retains the rear wall 13 of the bin 11 or 11*a*, while the split connector 18*b* is attached to a spacer member 20 of a side wall 14. The split connector 18*b* has only a half flange portion 25 positioned on the web portion 24.

The connectors 18 may be decorated to provide various aesthetic appeals. For example, the connectors 18 may be painted various colors; covered with various prepainted or formed members which slip over or clip over the flanges 25; or decorated by various materials, such as redwood, cement asbestos board, or bonded cementitious material which adheres directly to the flanges 25 or the formed cover. As shown in FIG. 16, the cover member 22 tightly fits onto the flange portion 25 of each connector 18.

A plurality of stringers 19, as shown in FIG. 5, forms the rear wall 13. Each stringer 19 is supported by the connectors 18 positioned in the plane of the rear wall 13. The slant of the stringers 19 of the rear wall 13 depends upon the position of the connectors 18 relative to the ground. If the connectors are perpendicularly or vertically placed in the ground, the rear wall 13 will be similarly positioned. If the connectors 18 are angled or battered, likewise, the rear wall 13 will be angled or battered. As shown in FIG. 8, the stringers 19 forming the rear wall 13 may be U-shaped in cross section and they have outwardly extending flanges 26. Each outwardly extending flange 26 is attached at the ends thereof to a flange portion 25 of a connector 18. To achieve this attachment, conventional bolts 27 or a variety of other fastening means may be used. The stringers 19 may be made from either metal, cementitious material or other substances which provide the requisite rigidity, strength and support.

A plurality of spacer members 20 form each side wall 14 of the bins 11. Each end of a spacer member 20, as shown in FIG. 8, is joined to the web portion 24 of a connector 18. As with the stringers 19, the spacer members 20 are generally U-shaped in cross section with outwardly extending flanges 30. Each flange 30 of the spacer member 20 is attached at the ends thereof to the web portion 24 of the connector 18. Bolts 27 or other fastening means may be used to accomplish this connection.

Figure 3:
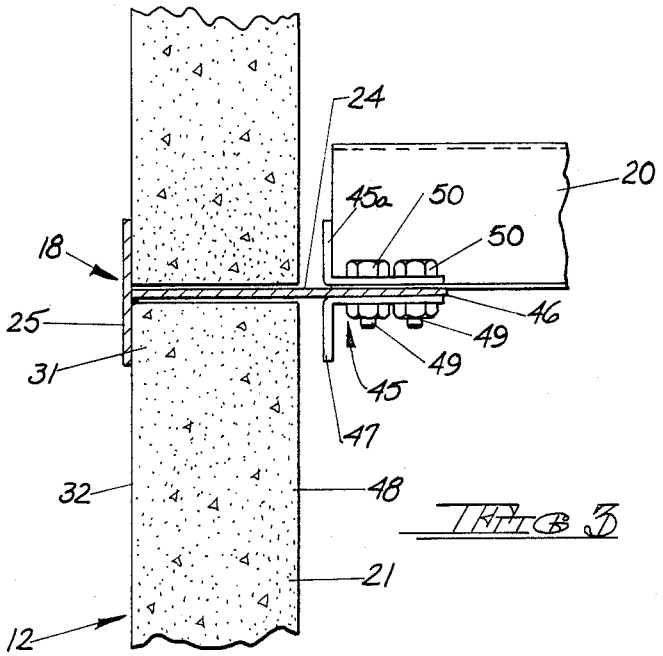
FIG. 3 is a top plan view showing the arrangement of the concrete panels of the front wall, the connector and the angle members.

The front wall 12 is formed by a plurality of cementitious panels 21. As called out in FIG. 3, the end portion 31 of the front face 32 of the panel 21 contacts against the flange portion 25 of the connector 18 positioned in the plane of the front wall 12. The end portion 31 may also be stationed against the web portion 24 of the connector 18 or it may be separated therefrom by a small distance as shown in FIG. 3. By contacting against the flange portion 25, the cementitious panels 21 are maintained in a fixed position with respect to the ground. The cementitious panels 21 are precast and preferably reinforced. For example, the panels may have a concave or convex face as shown in FIG. 17. The preferred shape of the panels is rectangular with a length of approximately 10 feet and a height of approximately 32 inches, although other shapes and sizes are permitted within the scope of the invention. Reinforcement could include steel rods, fibers, glass fibers, carbon fibers, or other high strength materials.

Figure 2:
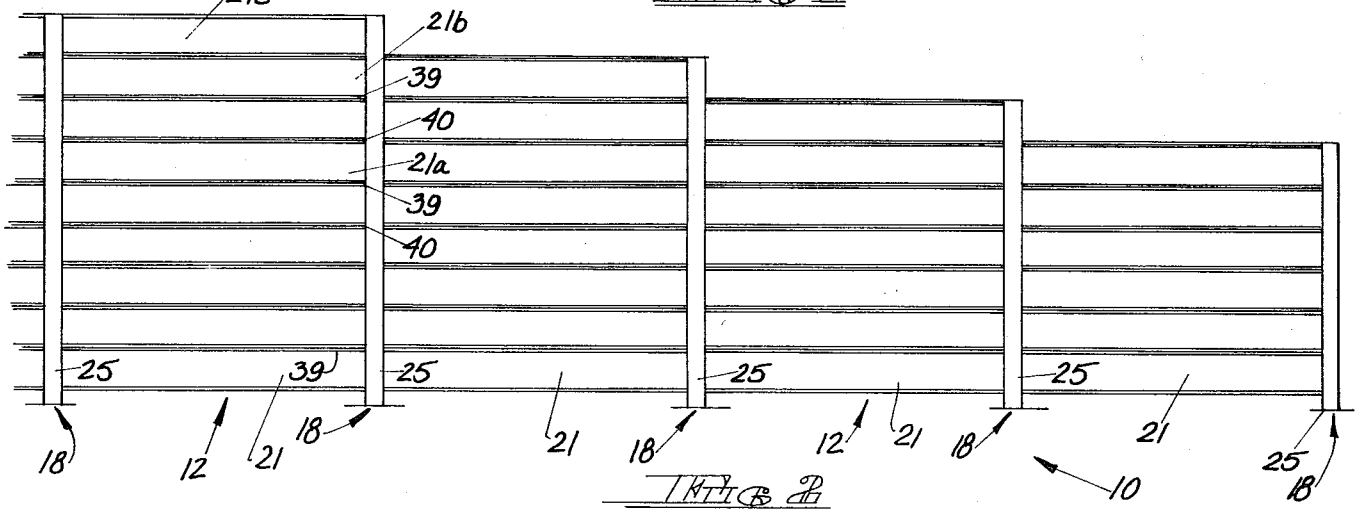
FIG. 2 is a front elevational view thereof.
Figure 6:
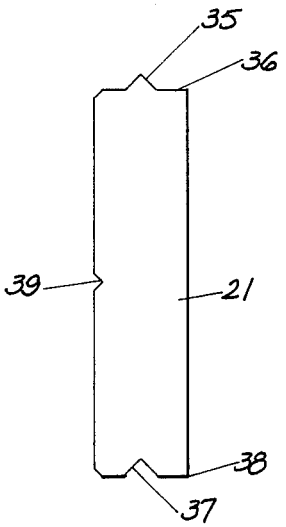
FIG. 6 is an end view of one of the cementitious panels shown in FIG. 5.
Figure 7:
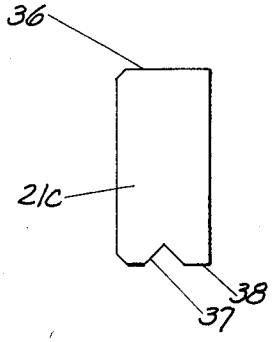
FIG. 7 is an end view of the cap cementitious panels shown in FIG. 5.

As shown in FIGS. 5–7, preferably each cementitious panel 21 has a tongue joint 35 along one lengthwise edge of each panel, such as the top edge 36. Similarly, each panel 21 has a groove 37 along a corresponding lengthwise edge, such as the bottom edge 38. The groove 37 corresponds in shape to the shape of the tongue 35 to allow the tongue 35 of one panel **21*a* to mate with the groove 37 of a vertically adjacent panel 21*b*. The top 36 and bottom 38 edges of the panels 21 preferably are also chamfered to prevent chipping and spalling during handling. The cap cementitious panel 21*c*, as shown in FIG. 7, preferably is used at the top of the front wall 12 as shown in FIG. 5. The cap cementitious panel 21*c* has a groove 37 along its bottom edge 38, but it does not have a tongue 35 along the top edge 36. Rather, the top edge 36 is flat so as to provide a finished off look to the top of the wall. The cap panels 21*c* are preferably made to be one-half of the height of the regular panels 21*a* and 21*b*, although other heights are permitted. A V-notch 39 is placed along the mid-line of the cementitious panels 21*a* and 21*b* to give the appearance, as shown in FIG. 2, that all of the panels are of the same height since the V-notch lines 39 and the joint lines 40, at which two cementitious panels 21 are joined together by mating tongues 35 and grooves 37, appear alike. In order to ease the handling of the panels 21 when constructing the front wall 12, an anchor or similar lifting devices may be embedded into the cementitious panels so that the panels 21** may be picked up from a flat or vertical position and handled easily.

As shown in FIG. 3, a retaining means, such as an angle member indicated generally at 45, is located on the web portions 24 of the connectors 18 for retaining the cementitious panels 21 of the front wall 12 in an erect position. Preferably, one angle member 45 is attached to each connector 18 and the length of the angle member 45 coincides with the length of the connector 18 to which it is attached. Alternatively, a number of angle members 45, each of which is a small segment, may be located on a particular connector 18. The angle member 45 is L-shaped in cross section and it includes a connecting leg 46 and a positioning leg 47. The connecting leg 46 of the angle member 45 is joined to the web portion 24 of the connector 18 which in turn is joined to the spacer members 20. Preferably, the retaining angle 45 is attached to the web portion 24 at the point where the outwardly extending flanges 30 of the spacer member 20 are also joined to the web portion 24 of the connector 18. By making the two connections at the same point on the web portion 24, one set of nuts 49 and bolts 50 may be used. Other fastening means may also be used to attach the connecting leg 46 to the web portion 24. Alternatively, the connecting leg 46 may be attached directly to the spacer member 20.

Figure 10:
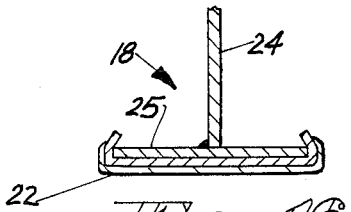
FIG. 10 is a perspective view showing a short angle member on a connector to support the top cementitious panel of the front wall.
Figure 10:
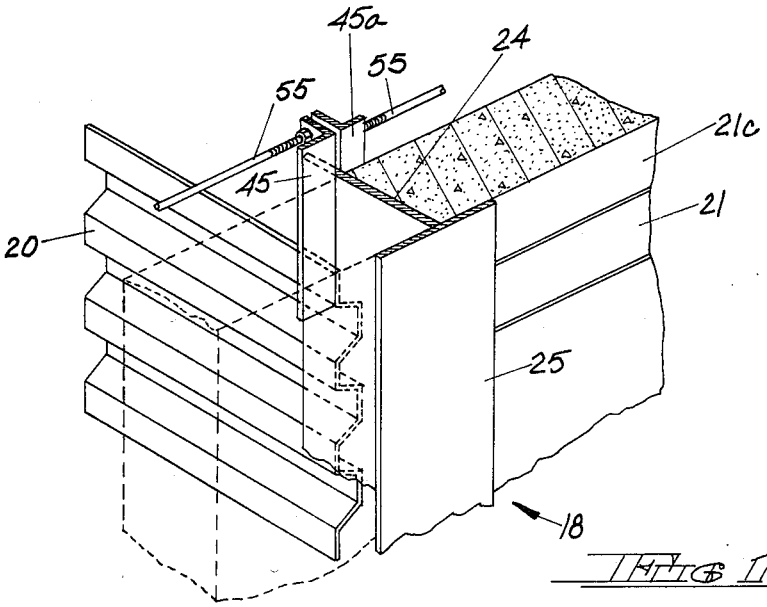

Preferably, the total height of all of the spacer members 20 forming the side wall 14 corresponds to the height of the front wall 12 less the height of the cap panel **21*c*. A short angle member 45*a*, as shown in FIGS. 3 and 10, is attached to web portion 24 of a connector 18 at the top of the spacer member 20 of the side wall 14 to support the cap panel 21*c* in an erect position. The length of the short angle member 45*a* is slightly greater than the height of the cap panel 21*c*. For example, a length of 20 inches will be sufficient when the height of the cap panel 21*c* is 16 inches. The short angle member 45*a* is needed on the web portion 24 of the connector 18 at the top portion of the spacer member 20 to support part of the cap panel 21*c*, since the long angle member 45 is attached to only one side of the web portion 24 of the connector 18**.

The positioning leg 47 of the angle member 45 lies adjacent the rear face 48 of the cementitious panels 21 to prevent the cementitious panels 21 from falling from a vertical plane. The positioning leg 47 may be either in direct contact with the rear face 48 or closely spaced to the rear face 48 so that the cementitious panel 21 will rest against the positioning leg 47 as it moves from a substantially erect position. The angle members 45 are especially needed during the erection of the front wall 12 to support the cementitious panels 21 in a substantially erect position. Once the retaining wall 10 is fully erect and the bins 11 are filled with soil, the cementitious panels 21 will be held in place by the force of the soil within the bins.

Figure 4:
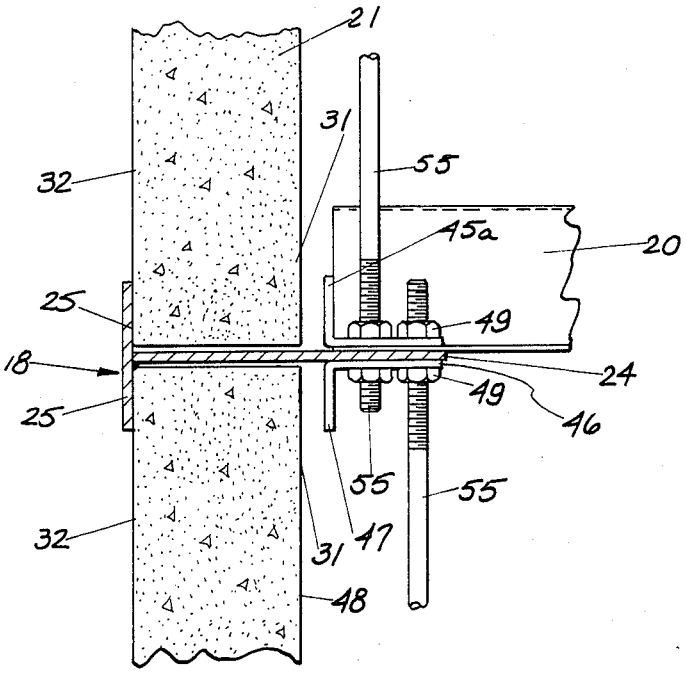
FIG. 4 is a top plan view showing the tie rod connectors on the end bins of the soil tight bin-type retaining wall.

Since the cementitious panels 21 are not connected to the spacer members 20, the addition of soil to the end bins 11*a* could result in the lateral displacement of the spacer members 20 and could cause the bins 11 to open up. To prevent this lateral displacement, as shown in FIGS. 1 and 4, a securing means, preferably one or more tie rods 55, are used on at least one bin 11*a* at each end of the retaining wall 10. The tie rods 55 interconnect the spacer members 20 of two opposite side walls 14 of the last bin 11*a*. Additional bins 11 adjacent to the end bin 11*a* may also be interconnected by the tie rods 55 to insure that the bins may not open up under the stress of the soil. Each end of the tie rod 55 is attached to the connecting leg 46 of an angle member 45 which is, in turn, joined to the web portion 24 of a connector 18 in the plane of the front wall. Ropes, cables or the like may also be used in place of the tie rods 55. Alternatively, the tie rods 55 are attached directly to the spacer member 20. By attaching, however, a tie rod 55 and a connector leg 46 to the web portion 24 at the point where a spacer member 20 also attaches to the web portion 24, only one fastening set is needed. In this attachment, the tie rod 55 substitutes for the bolt 50 which would normally be needed to pass through the nut 49. Other conventional fastening techniques may be used to join the tie rod 55 to the connecting leg 46.

The tie rods 55 lie adjacent to the rear face 48 of the cementitious panels 21. The tie rods 55 are preferably of $\frac{5}{8}$ inch diameter with a threaded length at each end which passes through the nuts 49. The number of tie rods 55 which are needed for each end bin 11*a* depends upon the height of the front wall 12. For example, it has been found that two tie rods 55 per bin are sufficient to support a front wall 12 ranging in height from 4.33 to 12.33 feet, while three tie rods 55 are needed when the front wall 12 has a height of 13.67 to 15.00 feet.

Although in the preferred embodiment of the present invention only the front wall 12 is formed of cementitious panels 21, it is also possible to construct the retaining wall so that all or some of the exposed walls are formed of cementitious panels 21 so as to provide the desired aesthetic effects. For example, the rear wall 13 can also be formed from one or more cementitious panels 21 which are joined together in a substantially vertical plane by tongues 35 mating with grooves 37 in the same manner as the panels 21 form the front wall 12. In a manner similar to that in which the angle members 45 support the cementitious panels of the front wall 12, one or more L-shaped angle members 45 are joined to the web portion 24 of the connectors 18 lying in the plane of the rear wall 13. These angle members 45 similarly have connector legs 46 and positioning legs 47, and the positioning leg 47 lies adjacent to the cementitious panels 21 of the rear wall 13 to maintain them in an erect manner. Likewise, tie rods 55 would lie adjacent to the rear face of the panels 21 of the rear wall 13 to prevent the end bins 11*a* from being laterally displaced. In some situations, the rear wall 13 may be composed of cementitious panels 21 while the front wall 12 is made of conventional metal stringers.

Similarly, some or all of the side walls 14 may also be formed of cementitious panels 21. As with the rear wall 13, when the side walls 14 are formed of cementitious panels, both retaining plates 81 similar to angle members 45 and tie rods 55 are to be used along such side walls 14 to retain the cementitious panels 21 in a substantially erect position. As shown in FIG. 13, when all of the front 12, rear 13, and side 14 walls are formed of cementitious panels 21, clip channels 80 need to be attached to the web portions 24 of the connectors 18. Since the tie rods 55 need to be used along all four walls of each bin, the clip channels 80 support the tie rods 55 of two walls which are at right angles to each other. Preferably, the clip channels 80 are welded to the web portion 24 of the connector 18. The L-shaped retaining plates 81 are also joined to the web portion 24 of the connectors 18. The retaining plate 81 is preferably made of metal and welded to the web portion 24. The retaining plate 81 supports the cementitious panels 21 in both the side walls 14 and either the front 12 or rear 13 walls. Corner vertical members 18*a* support the cementitious panels 21 which form the end side wall l4*a*.

Figure 9:
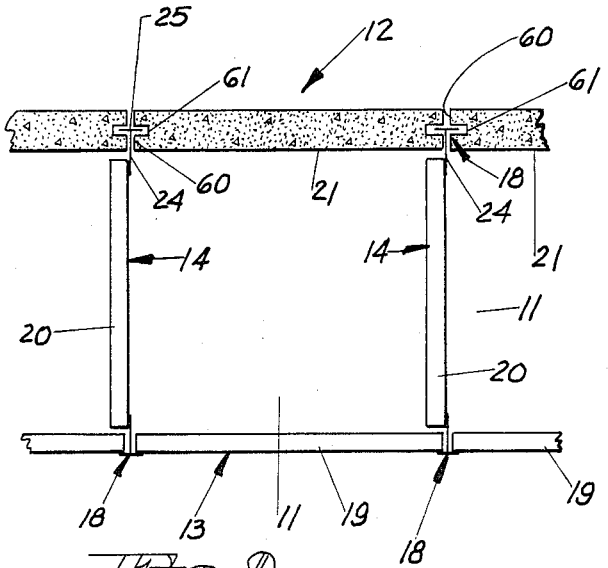
FIG. 9 is a top plan view of an alternative embodiment of the soil tight bin-type retaining wall in accordance with the present invention.

In an alternative embodiment of the present invention, as shown in FIG. 9, instead of using angle members 45 to maintain the cementitious panels 21 of the front wall 12 in an erect position, the side edges 60 of the cementitious panels 21 are provided with a groove 61 corresponding in size and shape to that of the flanges 25 of the connectors 18. The flanges 25 of each connector 18 in the plane of the front wall 12 are inserted within the groove 61 of horizontally adjacent cementitious panels 21 to align the panels 21 along the length of the front wall 12. The remainder of the retaining wall 10 is the same as that shown in the preferred embodiment in FIGS. 1–8 and, hence, the retaining wall 10 includes bins 11 formed by front walls 12, rear walls 13 and side walls 14. However, the angle members 45 and 45*a* on the connectors 18 may be omitted. One or more tie rods 55 are further located on at least one bin at each end of the retaining wall 10 for interconnecting the spacer members of the end bins. The tie rods 55 lie adjacent to the rear face 48 of the front wall 12. Each end of the tie rod 55 is attached to the web portion 24 of a connector in the plane of the front wall 12.

Alternatively, as shown in FIG. 15, all of the walls of the present invention can be constructed with cementitious panels 21 having the side edges 60 provided with a groove 61. One end of the flange portion 25 of each connector 18 is bent at a perpendicular angle so that the bent end of the flange portion 25 can be inserted into the groove 61 of the cementitious panels 21 forming the auxiliary side wall 87 lying adjacent to the spacer members 20 of the side wall 14. The size and shape of the grooves 61 of the cementitious panels 21 of the side walls 14 correspond to the size and shape of the flange portion 25 of the connectors 18 to allow the flange portion 25 to be inserted within the grooves 61 to maintain the panels 21 in an erect position. The bent end of the flange portion 25 is inserted within the grooves 61 of the panels 21 forming an auxiliary side wall 14 while the unbent end of the flange portion 25 is inserted within the grooves 61 of the cementitious panels 21 of the rear wall 13 and front walls 12. Spacer members 20 are fastened to each pair of connectors 18 to maintain the shape of the bins being formed. The spacer members 20 are fastened to the web portion 24 of the connectors by bolts 50 and nuts 49.

Figure 11:
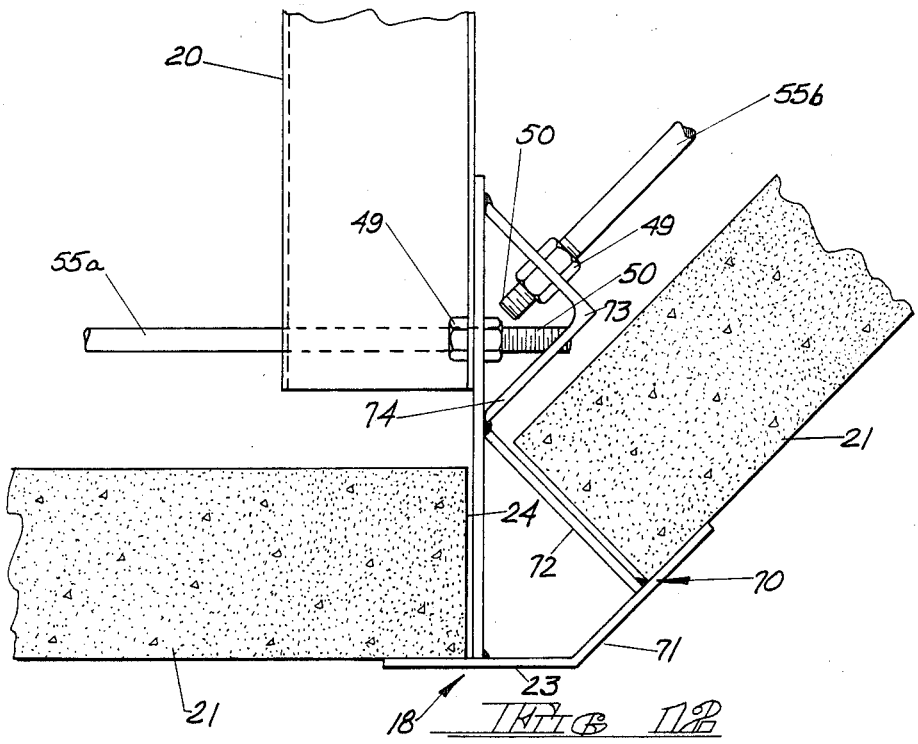
FIG. 11 is a top plan view of another alternative embodiment of the present invention.
Figures 10, 11:
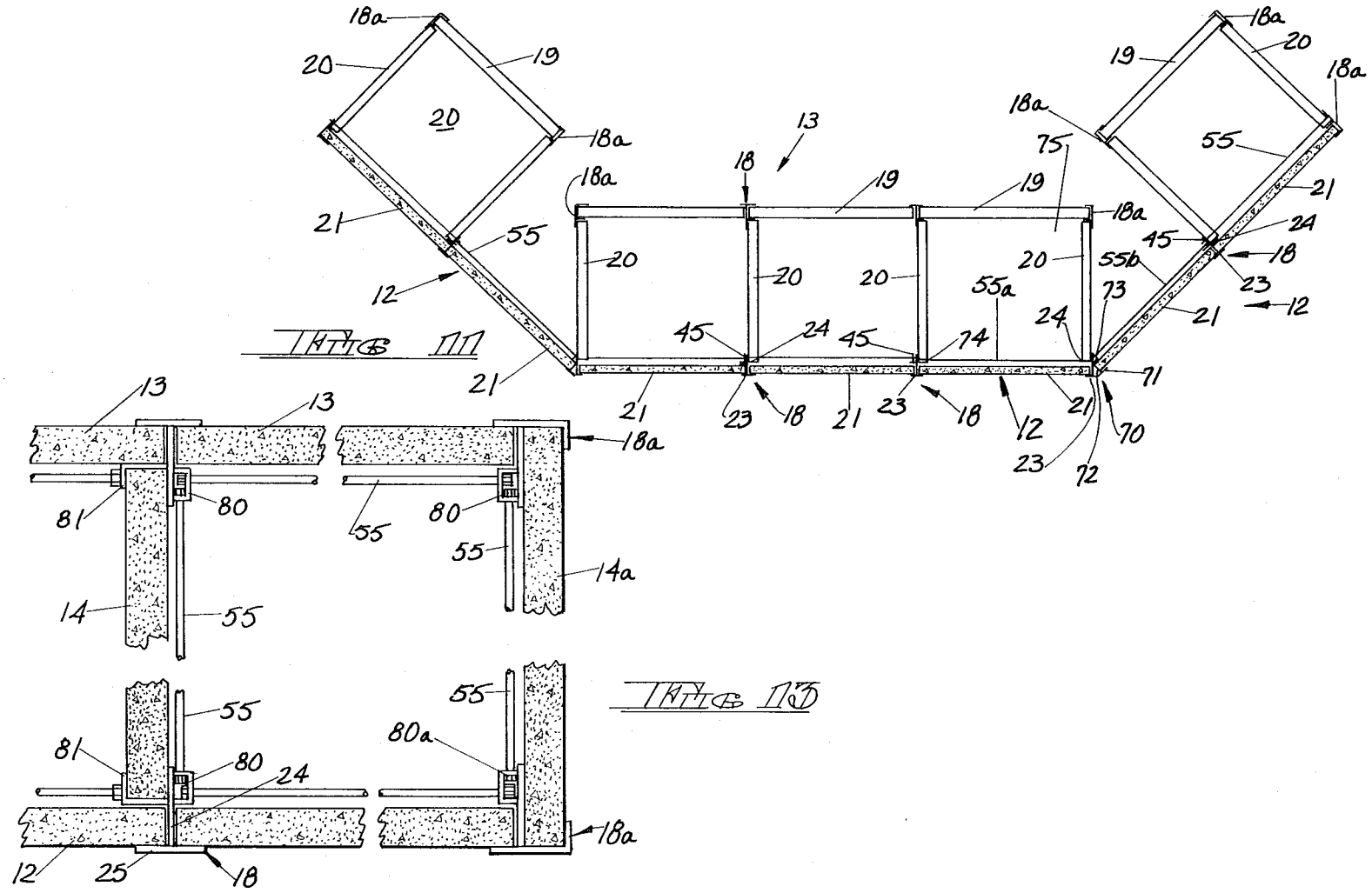

In another alternative embodiment of the present invention, as shown in FIGS. 11, 12 and 14, a retaining wall is provided which is capable of changing the configuration of the wall. The ability to change the contour or direction of either the front wall 12 or the rear wall 13 affords maximum flexibility to the user of the retaining wall in being able to position the retaining wall exactly where it is desired. By continually changing the direction of the front wall 12 or the rear wall 13, the retaining wall may be constructed so that its two ends meet. The retaining wall of this alternative embodiment uses special corner members 70 to change the inward direction of the wall supported by the connectors to which the corner members 70 are attached. The special corner members 70 include a flange portion 71 and a web portion 72 joined to the flange portion 23 and web portion 24, respectively, of a connector 18. As shown in FIG. 12, the special corner member 70 has the two flange portions 71 and 23 joined or formed together at the desired angle to change the inward direction of the front wall 12. The two web portions 72 and 24 are positioned substantially normal to and centrally on the flange portions 71 and 23, respectively. An L-bracket 73, similar in shape to the angle member 45, is joined at each end to the web portion 24. The interior end 74 of the L-bracket 73 is also joined to the web portion 72 at the point wherein it joins the web portion 24. Preferentially, this joining together of the L-bracket 73 and the web portions 24 and 72 is achieved by welding.

The L-bracket 73 retains the cementitious panels of the front wall 12 in a substantially erect position even as the contour of the front wall 12 is changed. The tie rods 55 further interconnect the spacer members 20 to prevent the lateral displacement of the bins, and they also support the cementitious panels 21. As shown in FIGS. 11 and 12, the tie rods 55 are joined to the web portions 24 of the connectors 18 along the unchanged configuration of the front wall. At those points of the front wall 12 where the direction of the front wall 12 is inwardly being changed by the special corner member 70, the tie rods **55*a* of the end bin 75 are connected to the web portion 24. At least one bin in each segment of the retaining wall prior to a change in the direction of the wall has the tie rods 55*a* to interconnect the spacer members 20 of the end bins to prevent the lateral displacement of the bins. The tie rods 55*b* are connected to the L-bracket 73. Conventional nuts 49** may be used to achieve this connection.

The special corner members 70 can be attached to the I5 connectors 18 either in the plane of the front wall 12 or the rear wall 13. Accordingly, the front wall 12, the rear wall 13 or a combination thereof can be varied in direction by the corner members 70.

As shown in FIG. 14, the wall can also be changed in an outward direction. To change the direction of the front wall 12 in an outward direction, a corner connector **18*a* is used to support the front wall 12 and the side wall 14. The corner connector 18*a* has only a half flange portion 25. A Z-shaped brace 85 is attached to the web portion 24 of the corner connector 18*a*. The Z-shaped brace 85 supports the cementitious panels 21 of the front wall 12*a* of the bin which extends outwardly at an angle from the front wall 12 to maintain the panels 21** in an erect position.

What is claimed is:

1. A soil tight bin-type retaining wall having front, rear and side walls:

a. a plurality of pairs of T-shaped connectors, each of the connectors having a web portion substantially normal to and positioned centrally on a flange portion, one connector of each pair being positioned in the plane of the front wall and the other connector of each pair being positioned in the plane of the rear wall;

b. a plurality of stringers forming the rear wall, each of the stringers being supported by two connectors positioned in the plane of the rear wall;

c. a plurality of stringers forming the rear wall, each stringers being supported by two connectors positioned in the plane of the rear wall;

d. a plurality of spacer members forming each side wall, each spacer member being supported by the web portion of a pair of connectors;

e. a plurality of cementitious panels forming the front wall, each end portion of the front face of each cementitious panel being supported by the flange portion of a connector positioned in the plane of the front wall to support the cementitious panel in a substantially erect position; and f. a retaining means on the web portions of the connectors for retaining the cementitious panels of the front wall in a substantially erect position, whereby a retaining wall having a plurality of bins with a cementitious panel front wall is formed, said retaining means comprising one or more angles members being L-shape in cross section and including a connecting leg and a positioning leg, said connecting leg being joined to the web portion of a convector, and the positioning leg lying either adjacent to or abutting against one or more cementitious panels of the front wall.

2. A soil tight bin-type retaining wall as described in claim 1 wherein each cementitious panel has a tongue joint along one lengthwise edge and a groove along the other lengthwise edge, the size and shape of the tongue joint and groove corresponding to allow the tongue joint of one centitious panel to mate with the groove of a vertically adjacent cementitious panel.

3. A soil tight bin-type retaining wall as described in claim 1 further including a securing means on at least one bin at each end of the retaining wall for interconnecting the spacer members of the end bins to prevent the lateral displacement of the bins.

4. A soil tight bin-type retaining wall as described in claim 3 wherein the securing means comprises one or more tie rods lying adjacent to the rear face of the front wall, each end of the tie rod being attached to the web portion of a connector in the plane of the front wall.

5. A soil tight bin-type retaining wall as described in claim 1 wherein the cementitious panels are reinforced precast panels.

6. A soil tight bin-type retaining wall as described in claim 1 wherein each stringer is generally U-shaped in cross section with outwardly extending flanges, each outwardly extending flange of the stringers being attached at the ends thereof to the flange portions of the connectors positioned in the plane of the rear wall.

7. A soil tight bin-type retaining wall as described in claim 1 wherein the stringers forming the rear wall are made of a cementitious material.

8. A soil tight bin-type retaining wall as described in claim 1 further including a rear retaining means on the web portions of the connectors in the plane of the rear wall for retaining the cementitious stringers in a substantially erect position.

9. A soil tight bin-type retaining wall as described in claim 8 wherein the rear retaining means comprises one or more angle members being L-shaped in cross section and including a connecting leg and a positioning leg, the connecting leg of each angle member is joined to the web portion of a connector and the positioning leg lies adjacent to one or more cementitious stringers of the rear wall.

10. A soil tight bin-type retaining wall as described in claim 7 further including one or more tie rods lying adjacent to the rear face of the rear wall, each end of the tie rod being attached to the web portion of a connector in the plane of the rear wall.

11. A soil tight bin-type retaining wall as described in claim 1 wherein each spacer member is generally U-shaped in cross section with outwardly extending flanges, each outwardly extending flange of the spacer member being fastened at the ends thereof to the web portions of a pair of connectors.

12. A soil tight bin-type retaining wall as described in claim 1 wherein the spacer members forming one or more side walls are made of a cementitious material.

13. A soil tight bin-type retaining wall as described in claim 12 further including a side retaining means on the web portion of one or more connectors for retaining the cementitious spacer members in a substantially erect position.

14. A soil tight bin-type retaining wall having front, rear and side walls comprising:

a. plurality of pairs of T-shaped connectors, each of the connectors having a web portion substantially normal to and positioned centrally on a flange portion, one connector of each Pair being positioned to form the shape of the front wall and the the rear wall;

b. a plurality of stringers forming the rear wall, each of the stringers being supported by two connectors positioned in the plane of the rear wall;

c. a plurality of spacer members forming each side wall, each spacer member being supported by the web portion of a pair of connectors;

d. direction changing means for changing the direction of the front wall;

e. a plurality of cementitious panels forming the front wall, each end portion of the front face of each concrete panel contacting against at least one of the T-shaped connector or the direction changing means to support the cementitious panels in a substantially erect position; and f. a retaining means on the web portion of the connectors for retaining the cementitious panels of the front wall in a substantially erect position, whereby a retaining wall having a plurality of bins with the front wall varying in direction is formed, said retaining means comprising one or more angle members being L-shaped in cross section and including a connecting leg and a positioning leg, the connecting leg being joined to the web portion of a connector, the positioning leg lying either adjacent to or abutting against one or more cementitious panels of the front wall.

15. A soil tight bin-type retaining wall as described in claim 14 wherein the direction changing means for changing the front wall in an inward direction comprises one or more corner members having a flange portion and a web portion, the flange portion of the corner member being joined to the flange portion of a connector and the web portion of the corner member being joined to the web portion of the connector.

16. A soil tight bin-type retaining wall as described in claim 15 further comprising an L-bracket joined at each end to the web portion of a connector for maintaining the cementitious panels of the front wall in a substantially erect position at the point of direction change.

17. A soil tight bin-type retaining wall as described in claim 14 further including a securing means on at least one bin in each segment of the retaining wall prior to a change in direction of the front wall for interconnecting the spacer members of the end bins to prevent the lateral displacement of the bins.

18. A soil tight bin-type retaining wall as described in claim 17 wherein the securing means comprises one or more tie rods lying adjacent to the rear face of the front wall.

19. A soil tight bin-type retaining wall as described in claim 14, wherein the direction changing means for changing the front wall in an outward direction comprises one or more corner connectors in the plane of the front wall, the corner connectors having a web portion and a half flange portion, a Z-shaped brace being attached to the web portion of the corner connector, the Z-shaped brace supporting the cementitious panels of the front wall in an erect position.

20. A soil tight bin-type retaining wall having front, rear and side walls comprising:

a. a plurality of pairs of T-shaped connectors, each of the connectors having a web portion substantially normal to and positioned centrally on a flange portion, one connector of each pair being positioned in the plane of the front wall and the other connector of each pair being positioned in the plane of the rear wall;

b. a plurality of cementitious stringers forming the rear wall, each of the cementitious stringers being supported by the flange portions of two connectors positioned in the plane of the rear wall;

c. a plurality of cementitious spacer members forming each side wall, each spacer member being supported by the web portions of a pair of connectors;

d. a plurality of cementitious panels forming the front wall, each cementitious panel being supported by the flange portions of two connectors positioned in the plane of the front wall;

e. one or more clip channels attached to the web portions of each connector;

f. one or more tie rods lying adjacent to the rear face of each of the front, side and rear walls, each end of the tie rod being joined to a clip channel; and g. a retaining means on one or more connectors for retaining the cementitious spacer members of the side walls and the adjacent front or rear wall in a substantially erect position, whereby a retaining wall having a plurality of bins with all sides being formed of cementitious panels.

21. A soil tight bin-type retaining wall as described in claim 20 wherein the retaining means includes an L-shaped retaining plate on the web portion of one or more connectors.

* * * * *